US005277717A

United States Patent [19]

LaSalle et al.

[11] Patent Number: 5,277,717

[45] Date of Patent: * Jan. 11, 1994

[54] RAPIDLY SOLIDIFIED ALUMINUM LITHIUM ALLOYS HAVING ZIRCONIUM FOR AIRCRAFT LANDING WHEEL APPLICATIONS

[75] Inventors: Jerry C. LaSalle, Montclair; Santosh K. Das, Randolph, both of N.J.

[73] Assignee: AlliedSignal Inc., Morristownship, Morris Co., N.J.

[ * ] Notice: The portion of the term of this patent subsequent to Feb. 25, 2009 has been disclaimed.

[21] Appl. No.: 926,601

[22] Filed: Aug. 4, 1992

Related U.S. Application Data

[63] Continuation-in-part of Ser. No. 838,644, Feb. 20, 1992, abandoned.

[51] Int. Cl.[5] ..... C22F 1/04

[52] U.S. Cl. ..... 148/550; 148/552; 148/690; 148/691; 148/692; 148/693; 148/694; 148/417; 148/439; 419/60; 419/66; 419/67; 419/68; 419/69

[58] Field of Search ..... 148/439, 417, 552, 691, 148/692, 693, 694, 550, 690; 420/533, 535, 543, 552, 902; 419/60, 66–

[56] References Cited

U.S. PATENT DOCUMENTS

| | | | |
|---|---|---|---|
| 4,661,172 | 4/1987 | Skinner et al. | 148/439 |
| 5,091,019 | 2/1992 | LaSalle | 420/528 |
| 5,171,374 | 12/1992 | Kim et al. | 148/417 |

OTHER PUBLICATIONS

"Conference Proceedings of Aluminum-Lithium V", edited by T. H. Sanders and E. A. Starke, pub. MCE, (1989), pp. 1 to 37.

*Primary Examiner*—R. Dean
*Assistant Examiner*—Robert R. Koehler
*Attorney, Agent, or Firm*—Ernest D. Buff; Gerhard H. Fuchs

[57] ABSTRACT

A rapidly solidified, low density aluminum base alloy consists essentially of the formula $Al_{bal}Li_aCu_bMg_cZr_d$ wherein "a" ranges from about 2.2 to 2.5 wt %, "b" ranges from about 0.8 to 1.2 wt %, "c" ranges from about 0.4 to 0.6 wt % and "d" ranges from about 0.4 to 0.8 wt %, the balance being aluminum plus incidental impurities. The alloy is especially suited to be consolidated to produce a strong, tough, low density aircraft landing wheel.

6 Claims, 3 Drawing Sheets

2.4Li-1.0Cu-0.5Mg-0.45Zr

▲ 2.6Li-1.0Cu-0.5Mg-0.6Zr
H.T.=490°C 4 hr WQ; 148°C-12 hr

■ 2.4Li-1.0Cu-0.5Mg-0.45Zr
H.T.=490°C 4 hr WQ; 148°C-12 hr

● 2.2Li-1.0Cu-0.5Mg-0.7Zr
H.T.=540°C 4 hr WQ; 135°C 16 hr

RAPIDLY SOLIDIFIED ALUMINUM LITHIUM ALLOYS HAVING ZIRCONIUM FOR AIRCRAFT LANDING WHEEL APPLICATIONS

CROSS REFERENCE TO RELATED APPLICATIONS

This application is a continuation-in-part of application Ser. No. 838,644, filed Feb. 20, 1992, abandoned.

FIELD OF THE INVENTION

The invention relates to aluminum metal alloys having reduced density. More particularly, the invention relates to aluminum-lithium-zirconium powder metallurgy alloys that are capable of being rapidly solidified and subsequently formed into structural components such as aircraft landing wheels having a combination of high ductility (toughness) and high tensile strength to density ratio (specific strength).

BRIEF DESCRIPTION OF THE PRIOR ART

The need for structural aerospace alloys of improved specific strength and specific modulus has long been recognized. It has been recognized that the elements lithium, beryllium, boron, and magnesium could be added to aluminum alloys to decrease the density. Current methods of production of aluminum alloys, such as direct chill (DC) continuous and semi-continuous casting have produced aluminum alloys having up to 5 wt % magnesium or beryllium but the alloys have generally not been adequate for widespread use in applications requiring a combination of high strength, good toughness and low density. Lithium contents of about 2.5 wt % have been satisfactorily cast in the lithium-copper-magnesium family of aluminum alloys such as 8090, 8091, 2090, and 2091. These alloys have copper and magnesium additions in the 1 to 3 wt % and 0.25 to 1.5 wt % range, respectively. In addition, zirconium is also added at levels up to 0.16 wt %.

The above alloys derive their good strength and toughness through the formation of several precipitate phases which are described in detail in the Conference Proceedings of Aluminum-Lithium V, edited by T. H. Sanders and E. A. Starke, pub MCE, (1989). An important strengthening precipitate in aluminum-lithium alloys is the metastable δ' phase which has a well defined solvus line. Thus, aluminum-lithium alloys are heat treatable, their strength increasing as δ' homogeneously nucleates from the supersaturated aluminum matrix.

The δ' phase has an ordered $Ll_2$ crystal structure and the composition $Al_3Li$. The phase has a very small lattice misfit with the surrounding aluminum matrix and thus a coherent interface with the matrix. Dislocations easily shear the precipitates during deformation resulting in the buildup of planar slip bands. This, in turn, reduces the toughness of aluminum lithium alloys. In binary aluminum-lithium alloys where this is the only strengthening phase employed, the slip planarity results in reduced toughness.

The addition of copper and magnesium to aluminum-lithium alloys has two beneficial effects. First, the elements reduce the solubility of lithium in aluminum, thus increasing the amount of lithium available for strengthening precipitates. More importantly, however, the copper and magnesium allow the formation of additional precipitate phases, most importantly the orthorhombic S' phase ($Al_2MgLi$) and the hexagonal $T_1$ phase ($Al_2CuLi$). Unlike δ', these phases are resistant shearing by dislocations and are effective in minimizing slip planarity. The resulting homogeneity of the deformation results in improved toughness, increasing the applicability of these alloys over binary aluminum-lithium. Unfortunately, these phases form sluggishly, precipitating primarily on heterogeneous nucleation sites such as dislocations. In order to generate these nucleation sites, the alloys must be cold worked prior to aging.

Additions of zirconium under approximately 0.15 wt % are typically added to the alloys to form the metastable $Al_3Zr$ phase for grain size control and to retard recrystallization. Metastable $Al_2Zr$ consists of an $Ll_2$ crystal structure which is essentially isostructural with δ' ($Al_3Li$). Additions of zirconium to aluminum beyond 0.15 wt % using conventional casting practice result in the formation of relatively large dispersoids of equilibrium $Al_3Zr$ having the tetragonal $DO_{23}$ structure.

Much work has been done to develop the aforementioned alloys which are currently near commercialization. However, the processing constraint imposed by the need for cold deformation has limited the application of these alloys to thin, low dimensional shapes such as sheet and plate. Complex, shaped components such as forgings are unsuitable to such processing. Consequently, there are currently no conventional aluminum-lithium alloy forgings having desirable combinations of strength, ductility, and low density required in aircraft forgings.

D. J. Skinner, K. Okazaki, and C. M. Adam, U.S. Pat. No. 4,661,172 (1987) have developed a series of aluminum-lithium alloys whereby rapid solidification techniques were employed to produce structural components of alloys containing lithium between 3.5 and 4.0 wt %. These alloys exhibit good strength values but have toughness lower than that considered desirable for use in aircraft forgings.

SUMMARY OF THE INVENTION

The invention provides a low density aluminum-base alloy, consisting essentially of the formula $Al_{bal}Li_aCu_bMg_cZr_d$ wherein "a" ranges from 2.2 to 2.5 wt %, "b" ranges from 0.8 to 1.2 wt %, "c" ranges from about 0.4 to 0.6 wt %, and "d" ranges from about 0.4 to 0.8 wt %, the balance being aluminum plus incidental impurities.

The invention also provides a method for producing consolidated article from a low density, aluminum-lithium-copper-magnesium-zirconium alloy. The method includes the step of compacting together rapidly solidified particles composed of a low density aluminum-lithium-copper-magnesium-zirconium alloy, consisting essentially of the formula $Al_{bal}Li_aCu_bMg_cZr_d$ wherein "a" ranges from 2.2 to 2.5 wt %, "b" ranges from 0.8 to 1.2 wt %, "c" ranges from 0.4 to 0.6 wt %, "d" ranges from 0.4 to 0.8 wt % and the balance is aluminum plus incidental impurities. The rapidly solidified alloy particulate has a primary, cellular dendritic, fine-grained supersaturated aluminum alloy solid solution phase with filamentary, intermetallic phases of the constituent elements uniformly dispersed therein. These intermetallic phases have width dimensions of not more than about 100 nm. The compacted alloy is solutionized by heat treatment at a temperature ranging from about 460° C. to 550° C. for a period of approximately 0.5 to 5 hours, quenched in a fluid bath held at approximately 0°-80° C. and optionally, aged at a temperature ranging from about 100° C. to 250° C. for a period ranging from about 1 to 40 hrs.

The consolidated and heat treated article of the invention has a distinctive microstructure composed of an aluminum solid solution containing therein a substantially uniform dispersion of intermetallic precipitates. These precipitates are composed essentially of fine intermetallics measuring not more than about 30 nm along the largest linear dimension thereof. In addition, the article of the invention has density of not more than about 2.6 grams/cm$^3$ an ultimate tensile strength of at least about 450 MPa, an ultimate tensile strain to fracture of about 5% elongation, and a V-notch impact toughness in the C-L direction of at least $2.6\times10^{-2}$ joule/mm$^2$, all measured at room temperature (about 20° C.).

Thus, the invention provides distinctive aluminum-base alloys that are particularly capable of being formed into consolidated articles such as aircraft landing wheels and related landing gear components that have a combination of high strength, toughness and low density. The method of the invention advantageously minimizes coarsening of zirconium rich, intermetallic phases within the alloy to increase the ductility of the consolidated article, and maximized the amount of zirconium held in the aluminum solid solution phase to increase the strength while maintaining toughness of the consolidated article. As a result, the article of the invention has an advantageous combination of low density, high strength, high elastic modulus, good ductility and high toughness. Such alloys are particularly useful for lightweight structural parts such as aircraft landing wheel applications.

BRIEF DESCRIPTION OF THE DRAWINGS

The invention will be more fully understood and further advantages will become apparent when reference is made to the following detailed description of the preferred embodiment of the invention and the accompanying drawings in which.

DESCRIPTION OF THE PREFERRED EMBODIMENTS

Figure 1:
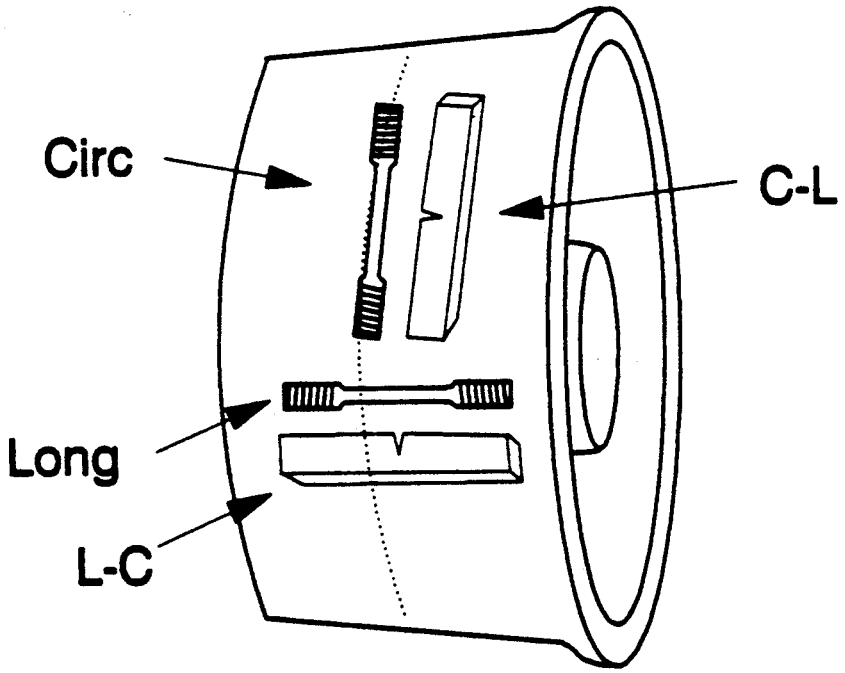
FIG. 1 is a schematic illustrating the orientation and position of samples taken from an aircraft landing wheel.

The invention provides a low density aluminum-base alloy, consisting essentially of the formula $Al_{bal.}Li_aCu_bMg_cZr_d$ wherein "a" ranges from about 2.2 to 2.5 wt %, "b" ranges from about 0.8 to 1.2 wt %, "c" ranges from about 0.4 to 0.6 wt %, "d" ranges from about 0.4 to 0.8 wt % and the balance is aluminum plus incidental impurities. The alloys contain selected amounts of lithium and magnesium to provide high strength and low density. In addition, the alloys contain secondary elements to provide ductility and fracture toughness. The element copper is employed to provide superior precipitation hardness response by reducing the solid solubility of Li. The element zirconium forms nonshearable $Al_3(Zr,Li)$ precipitates which homogenize the dislocation substructure during deformation improving ductility and toughness. These $Al_3(Zr,Li)$ precipitates provide grain size control by pinning the grain boundaries during thermomechanical processing resulting in a very fine, equiaxed grain structure. Alloys of the invention are produced by rapidly quenching and solidifying a melt of a desired composition at a rate of at least about $10^{5°}$ C./sec onto a moving chilled casting surface. The casting surface may be, for example, the peripheral surface of a chill roll. Suitable casting techniques include, for example, planar flow casting through a slot-type orifice. Other rapid solidification techniques, such as melt atomization and quenching processes, can also be employed to produce the alloys of the invention in nonstrip form, provided the technique produces a uniform quench rate of at least about $10^{5°}$ C./sec.

After communition to suitable particle size of about −60 to 200 mesh, the the alloy particulate is degassed in a vacuum of less than about $10^{-4}$ Torr ($1.33\times10^{-2}$ pa) at temperatures of not less than about 450° C. to ensure complete removal of gaseous species from the surfaces of the comminuted particulate. The degassed particulate is then compacted into a billet at a temperature ranging from about 300°–450° C., for example by being blind-die compacted in an extrusion or forging press. The compacted billet is then extruded into a forging preform at a temperature of about 300°–450° C. and the forging preform is then forged at a temperature of about 300°–450° C. in single or multiple forging steps.

The forged alloy component is solutionized by heat treatment at a temperature ranging from about 460° C. to 550° C. for a period of approximately 0.5 to 5 hrs. to convert elements, such as Cu, Mg, and Li, from microsegregated and precipitated phases into the aluminum solid solution phase. This solutionizing step also produces an optimized distribution of $Al_3(Zr,Li)$ particles ranging from about 10 to 30 nanometers in size. The alloy article is then quenched in a fluid bath, preferably held at approximately 0° to 60° C. The compacted article is aged at a temperature ranging from about 100° C. to 250° C. for a period ranging from about 1 to 40 hrs. to provide selected strength/toughness tempers.

The forged alloy wheels in their peak aged condition have a tensile yield strength ranging from about 380 MPa (55 ksi) to 450 MPa (65 ksi), an ultimate tensile strength from about 450 MP (65 ksi) to 520 MPa (75 ksi) with an elongation to fracture ranging from about 5 to 11% when measured at room temperature (20° C.). The forged alloy wheels also have a V-notch charpy impact energy in the L-C orientation ranging about $2.5\times10^{-2}$ Joules/mm$^2$ to $4.5\times10^{-2}$ Joules/mm$^2$. In addition, the consolidated articles have a density less than 2.6 g/cm$^3$ and an elastic modulus of about $79\text{–}83\times10^6$ kpa ($11.5\text{–}12.0\times10^9$ psi).

The following examples are presented to provide a more complete understanding of the invention. The specific techniques, conditions, materials, proportions and reported data set forth to illustrate the principles and practice of the invention are exemplary and should not be construed as limiting the scope of the invention.

EXAMPLES 1-3

Alloys of the invention having nominal compositions listed in Table I below have been prepared by rapid solidification and were forged into Boeing 767-300 inboard wheel halves in accordance with the method of the invention.

TABLE I

| | | | | | |
|---|---|---|---|---|---|
| 1. | Al-2.4 | Li-1.0 | Cu-0.5 | Mg-0.45 | Zr |
| 2. | Al-2.2 | Li-1.0 | Cu-0.5 | Mg-0.6 | Zr |
| 3. | Al-2.6 | Li-1.0 | Cu-0.5 | Mg-0.6 | Zr |

EXAMPLE 4

Alloys listed in Table II were formed into consolidated articles via blind die compaction, extrusion, and forging in accordance with the method of the invention and exhibited the properties indicated in the Table. The consolidated and forged aircraft wheel halves were solutionized at temperatures listed in the table for 4 hrs. and quenched into an ambient temperature water bath; subsequently, they were aged at temperatures and times listed in the table and machined into round tensile specimens having a gauge diameter of 9.5 mm and a gauge length of 19 mm. Tensile testing was performed at room temperature at a strain rate of $5.5\times10^{-4}$ $sec^{-1}$. Notched charpy impact energies were measured on standard charpy specimens having a 0.025 mm notch radius. Both tensile and impact properties are from the L-C and C-L orientation of the tubewell of the wheel, illustrated in FIG. 1.

TABLE II

| Composition (wt %) Heat treatment | YS (MPa) | UTS (MPa) | El (%) | V-notch L-C J/mm² | V-notch C-L J/mm² |
|---|---|---|---|---|---|
| Al-2.2 Li-1.0 Li-0.5 Mg-0.6 Zr | 390 | 465 | 7.0 | $4.1\times10^{-2}$ | $2.9\times10^{-2}$ |
| Sol 490° C. aged 148° C.-12 hr | | | | | |
| Al-2.4-1.0 Li-0.5 Mg-0.45 Zr | 410 | 490 | 8.4 | $4.0\times10^{-2}$ | $3.7\times10^{-2}$ |
| Sol 490° C. aged 148° C. 12 hr | | | | | |
| Al-2.6 Li-1.0 Cu-0.5 Mg-0.6 Zr | 400 | 495 | 7.0 | $2.1\times10^{-2}$ | $1.8\times10^{-2}$ |
| Sol 540° C. aged 135° 16 hr | | | | | |

EXAMPLE 5

Alloys listed in Table III were formed into consolidated articles in accordance with the method of the invention and exhibited the densities indicated in the Table.

TABLE III

| Composition (wt %) | Density (g/cm³) |
|---|---|
| Al-2.2 Li-1.0 Cu-0.5 Mg-0.6 Zr | 2.58 |
| Al-2.4 Li-1.0 Cu-0.5 Mg-0.45 Zr | 2.55 |
| Al-2.6 Li-0.8 Cu-0.4 Mg-0.6 Zr | 2.53 |
| Pure aluminum (ref) | 2.70 |

EXAMPLE 6

Figure 2:
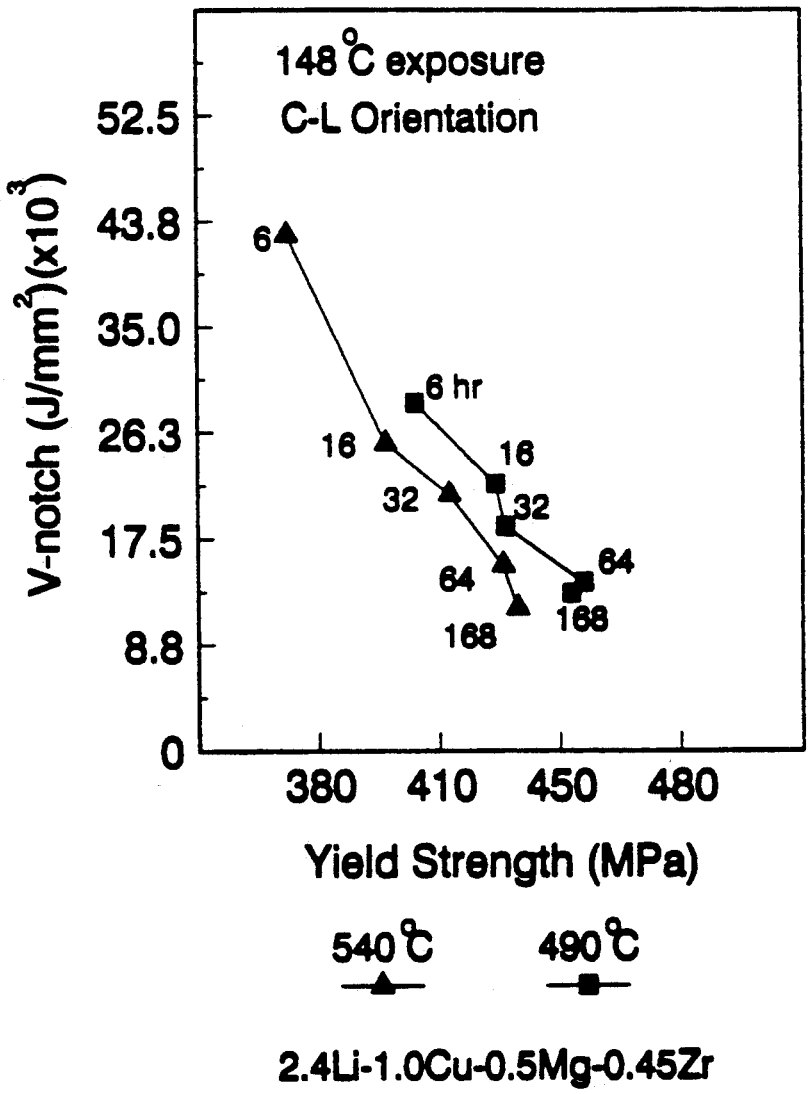
FIG. 2 plots the strength and toughness of a Al-2.4Li-1.0Cu-0.5Mg-0.45Zr pancake forging for 540° C. and 490° C. solutionization for various aging times at 148° C.
Figure 3:
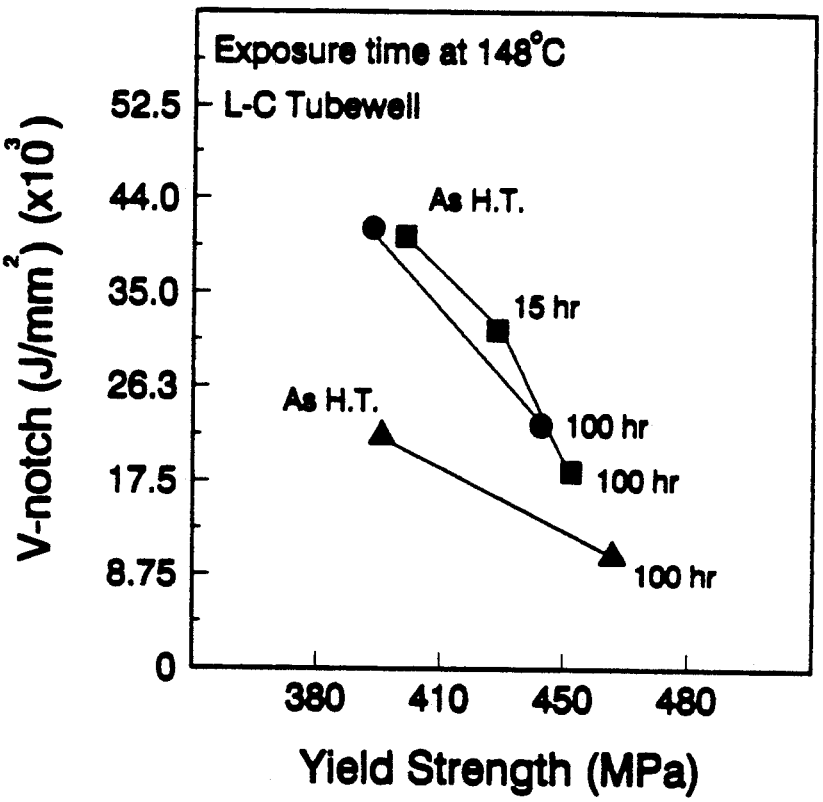
FIG. 3 plots the strength and toughness for a 767-300 inboard landing wheel half made from several compositions around the preferred composition range.

This example illustrates the age hardenable nature of these alloys, the inverse relationship between strength and V-notch impact energy, and the positive effect of lower solutionization temperature on the combined strength-toughness contribution. The tensile and impact properties of alloy Al-2.4Li-1.0Cu-0.5Mg-0.45Zr, oonsolidated in the aforementioned fashion by blind die compaction, extrusion, and single step upset forging into a pancake is plotted in FIG. 2. Specimens cut from the pancake forging were solutionized at either 540° C. or 490° C. for 2 hrs. and quenched into an ambient temperature water bath; subsequently, they were aged at 148° C. for from 6 to 200 hrs. and machined into circumferential oriented round tensile specimens having a gauge diameter of 9.5 mm and a gauge length of 19 mm. Tensile testing was performed at room temperature at a strain rate of $5.5\times10^{-4}$ $sec^{-1}$. Notched charpy impact energies were measured on circumferential-longitudinal standard charpy specimens having a 0.025 mm notch radius. FIG. 3 shows that with aging, the strength first increases and the toughness decreases until peak aging. Solutionizing at 490° C. rather than 540° C. results in higher toughness for a given strength level in the underaged temper.

EXAMPLE 7

This example illustrates the beneficial effect of reduced Li concentration on the toughness for a given strength over a range of thermal exposure times. The tensile and impact properties of three alloys consolidated in the aforementioned fashion by blind die compaction, extrusion, and multiple step forging into a main landing wheel is plotted in FIG. 3. Specimens, described in the Example 4, were cut from the tubewell section of an inboard 767-300 main landing wheel half after being given the thermal treatments listed in FIG. 3.

It is clear from FIG. 3 that the Al-2.4Li-1.0Cu-0.5Mg-0.45Zr alloy has an improved strength-toughness combination compared with the Al-2.6Li-1.0Cu-0.5Mg-0.6Zr alloy over a range of exposure times at 148° C.

Having thus described the invention in rather full detail, it will be understood that such detail need not be strictly adhered to but that various changes and modifications may suggest themselves to one skilled in the art, all falling within the scope of the invention as defined by the subjoined claims.

We claim:

1. A method for producing an aircraft landing wheel forging or related landing gear forged component from a rapidly solidified, low density, aluminum alloy, comprising the steps of:

a) forming a particulate composed of a rapidly solidified, low density aluminum-base alloy consisting essentially of the formula $Al_{bal}Li_aCu_bMg_cZr_d$ wherein "a" ranges from about 2.2 to 2.5 wt %, "b" ranges from about 0.8 to 1.2 wt %, "c" ranges from about 0.4 to 0.6 wt % and "d" ranges from about 0.4 to 0.8 wt %, the balance being aluminum plus incidental impurities, said rapidly solidified alloy particulate having a primary cellular dendritic, fine-grain, supersaturated aluminum alloy solid solution phase with filamentary, intermetallic phases of the constituent elements dispersed therein, and said intermetallic phases having width dimension of not more than about 100 nm;

b) degassing the alloy particulate in a vacuum less than about $10^{-4}$ Torr ($1.33\times10^{-2}$ Pa) at temperatures of at least about 450° C. to drive away adsorbed gases from the surface of the particulate;

c) compacting the degassed particulate at a temperature of about 300°–450° C.;

d) extruding the compacted billet into a forging preform at a temperature of about 300°–450° C.;

e) forging the extruded preform at a temperature of about 300°–450° C. in single or multiple step operations into the shape of the desired forged component;

f) solutionizing said compacted alloy by heat treatment at a temperature ranging from about 450° C. to 550° C. for a period of approximately 0.5 to 5 hrs. to convert elements from micro-segregated and precipitated phases into said aluminum solid solution phase;

g) quenching said compacted alloy in a fluid bath; and h) aging said compacted alloy at a temperature ranging from about 100°–250° C. for a period ranging from 1 to 40 hrs.

2. A forged aircraft landing wheel produced in accordance with a method as recited in claim 1.

3. A forged aircraft landing gear component produced in accordance with a method as recited in claim 1.

4. A forged aircraft landing wheel produced in accordance with the method as recited in claim 1, having a density of not more than 2.6 g/cm$^3$.

5. A forged aircraft landing gear component produced in accordance with the method as recited in claim 1, having a density of not more than 2.6 g/cm$^3$.

6. A forged aircraft landing wheel produced in accordance with the method as recited in claim 1, having a longitudinal 0.2% tensile yield strength of at least 380 MPa, ultimate tensile strength of 450 MPa, elongation to fracture of 5%, and a longitudinal-circumferential V-notch impact energy of at least $4.0\times10^{-2}$ Joules/mm$^2$.

* * * * *